US005285771A

United States Patent [19]

Griffes

[11] Patent Number: 5,285,771

[45] Date of Patent: Feb. 15, 1994

[54] MAKE-UP AIR CONTROL SYSTEM APPARATUS

[75] Inventor: Donald L. Griffes, East Charleston, Vt.

[73] Assignee: New England Ventilation Technologies, Newport, Vt.

[21] Appl. No.: 842,654

[22] Filed: Feb. 27, 1992

[51] Int. Cl.[5] ..... F24C 15/08; F23J 11/00

[52] U.S. Cl. ..... 126/299 D; 454/192

[58] Field of Search ..... 126/299 D; 454/66, 188, 454/191, 192, 303, 304

[56] References Cited

U.S. PATENT DOCUMENTS

| | | | |
|---|---|---|---|
| 3,364,839 | 1/1968 | Sweeney | 454/304 |
| 3,457,850 | 7/1969 | Sweet et al. | 126/299 D |
| 3,511,163 | 5/1970 | Newell et al. | 454/304 |
| 3,890,887 | 6/1975 | Kaufman et al. | 126/299 D |
| 4,129,121 | 12/1978 | Dorius | 126/299 D |
| 4,163,416 | 8/1979 | Kurrle et al. | 454/304 |
| 4,346,692 | 8/1982 | McCauley | 126/299 D |

*Primary Examiner*—Harold Joyce

*Attorney, Agent, or Firm*—Thomas N. Neiman

[57] ABSTRACT

The apparatus is adapted to provide for the controlling of incoming replacement or make up air in a cooking equipment ventilation system. The apparatus is dependent upon an air plenum surrounding the hood or an enclosure which contains the incoming, unconditioned make up air. The air is discharged into the cooking primarily by adjustable air controllers. The controllers are located at the lower lateral edge of the hood. The direction of the incoming replacement or make up air can be directed as desired for the required thermal conditions. The apparatus can be an integral part of a new ventilation hood assembly or system, or can be retrofit to a ventilation hood assembly or system already in operation.

4 Claims, 2 Drawing Sheets

MAKE-UP AIR CONTROL SYSTEM APPARATUS

This invention pertains to commercial kitchen ventilation hood systems and, in particular, to a replacement or make-up air control system apparatus for providing the variable control of the incoming replacement air in the vicinity of the cooking equipment ventilation exhaust hood and in a selected manner as thermal conditions dictate.

Those authorities responsible for fire safety and the accompanying regulations have stringent requirements for exhaust and replacement air for commercial kitchen ventilation systems and their air quantities and their relationships. Various codes require that sufficient outside or replacement air shall be provided so that cooking areas are adequately ventilated. Such air shall be approximately the same temperature as the air in the building or structure so as not to decrease the comfort level of the occupied space. Excluded from the temperature requirement are kitchen ventilation systems which furnish their own make-up air independent of all of the air furnished for the conditioning of the occupied space in the kitchen as well as other relevant areas of the building. Such ventilation hoods that furnish their own make-up air, often referred to as "compensating" hoods, shall not decrease comfort conditions of the occupied space and shall not decrease the capture velocity created by the hood fan.

Problems created by inadequate or uncontrolled replacement of air in commercial cooking situations include the following: grease build up can occur in the system which creates potential fire hazards; cold, uncontrolled drafts: insufficient capture and exhausting of smoke and grease laden vapors; unvented cooking odors can permeate the building; and, smoke and grease residue that contaminate and discolor surfaces.

Examples of devices designed to deal with these problems include the U.S. Pat. issued to Moriarty on Oct. 9, 1984, No. 4,475,534 for a Ventilation System For Kitchen Stove and the U.S. Pat. issued to Wooden, No. 4,655,194 for a System For Removing Fumes. The general function of these references and a number of others in the art is to provide conditioned and unconditioned make up air to enter the hood area. However, these references are limited as to the control of the direction and amount of the air throughout the ventilation hood system area and therefor can be inefficient, discomforting uncontrollable, and lacking as conditions change.

Clearly, it is desirable for a make-up air control system apparatus that can be installed to the open perimeter of a standard commercial ventilation hood, to regulate the incoming replacement or make-up air. It is the object of this invention, then to set forth a make-up air control system apparatus that avoids the disadvantages limitations, above-recited, which obtain in ventilation systems. It is also the object of this invention to teach an make-up air control system apparatus that can easily installed and, at the same time, be easily managed to operate as required at all times. It is another object of this invention to teach an apparatus that is versatile, variable, efficient and cost effective device that will disperse the replacement air in the vicinity of the ventilation hood as conditions require. Also, it is an object of this apparatus that allows for separate adjustment for each of the control device sections as desired.

Particularly, it is the object of this invention to set forth a make-up air control system apparatus, for use in controlling replacement or makeup air with cooking equipment ventilation hood systems, comprising a plenum enclosure; said plenum enclosure having an inlet; said plenum enclosure further having an outlet; said outlet having control means located therein; said control means comprising a rotatable housing; said rotatable housing having apertures located therein; said control means further comprising attachment means; said attachment means having apertures located therein; and pivot means for passing through said apertures in said rotatable housing and said attachment means to create a complete apparatus.

Further objects and features of this invention will become more apparent by reference to the following description taken in conjunction with the accompanying figures, in which.

Figure 1:
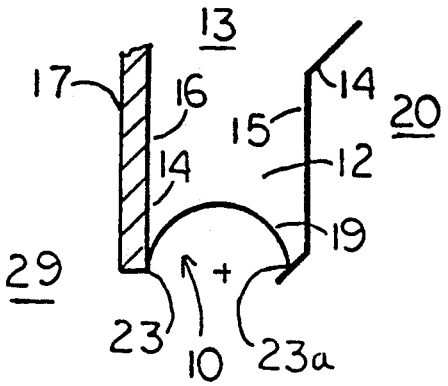
FIG. 1 is an side elevational view of the novel apparatus with the controller in the closed position.

As shown in the figures, the make-up air control system apparatus 10 is located lower outlet means 12 of the enclosure 13 which is installed in various ways to a standard ventilation hood 14 or to be an inherent part of a manufactured ventilation hood assembly. The enclosure 13 has an inner wall 15 which is positioned against or is comprises of the exterior of the ventilation hood 14 and outer wall 16 that is designed to form a complete enclosure around the exterior of the hood 14 and can be constructed of sheet rock 17 or other appropriate non combustible materials. The outer wall 16 of the enclosure is constructed so as to form an air tight plenum enclosure surrounding and above the hood 14 and is attached to the hood 14 and adjacent structure 28 by standard means of attachment used in the construction trade. The outlet area has several mounting brackets 18 and 18*a* positioned at each end of the rotatable controller 19 with aligned apertures 11 located at each end 20. The rotatable controller 19 with aligned apertures 11 is positioned in line with the apertures in the mounting brackets 18 and 18*a* and a pivot pin 22 is inserted through each aligned aperture.

Figure 2:
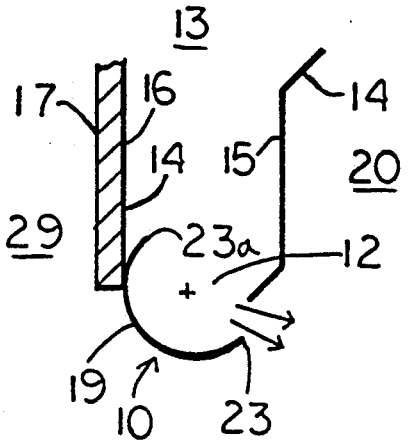
FIG. 2 is a side elevational view of the novel apparatus with the controller in a position to direct incoming replacement air into the ventilation hood, over the filters as shown by air flow indicator arrows.
Figure 3:
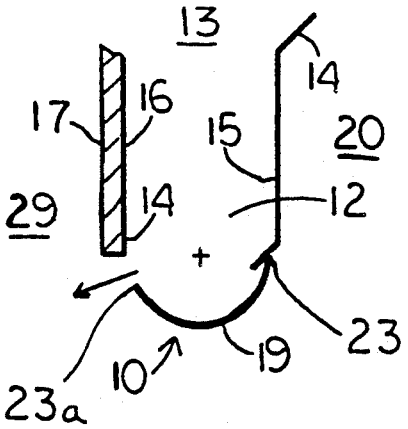
FIG. 3 is a side elevational view of the novel apparatus with the controller in a position to direct the incoming replacement air into the occupied space in front of the cooking equipment being ventilated.
Figure 4:
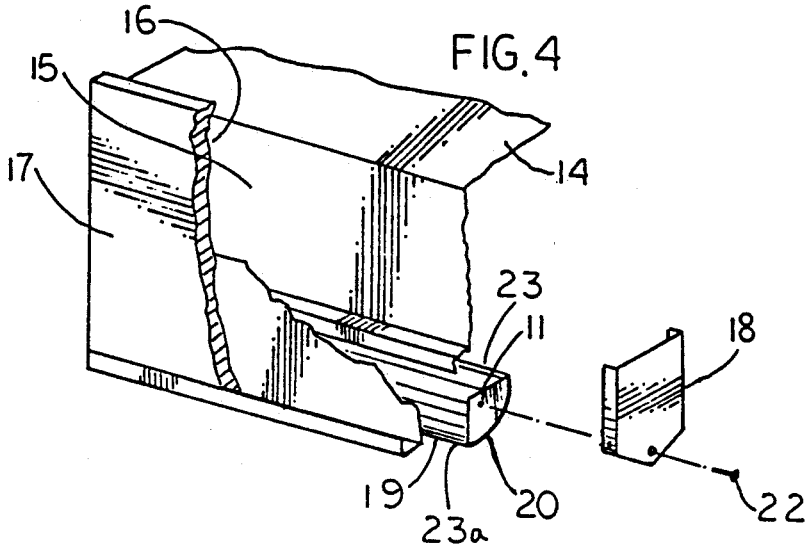
FIG. 4 is a perspective, cut away view of the novel apparatus.

This allows the controller 19 to be positioned as desired for optimum use. The controller 19 has outer lateral edges 23 and 23*a* and is cylindrical in shape which allows the apparatus to shut off air completely as shown in FIG. 1 or provide air to the hood and the open areas above the cooking equipment as shown in FIG. 2 or to provide air into the occupied space in front of the cooking equipment being ventilated as shown in FIG. 3 or various combinations thereof when the controllers are rotated to various positions or combinations thereof.

Figure 5:
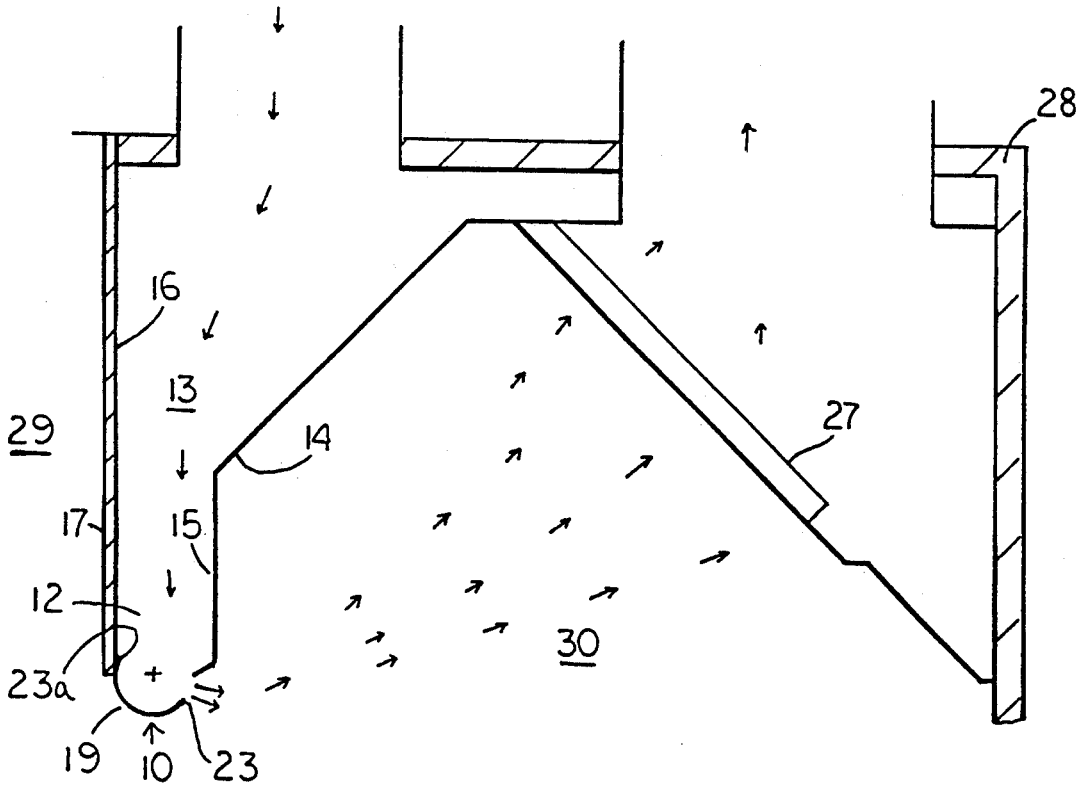
FIG. 5 is a cross-sectional view of the novel apparatus showing the air flow patterns in a typical cooking equipment ventilation system with the controller in the position shown in FIG. 2.

The apparatus is designed to use the space between the hood 14 and the plenum enclosure outer wall 16 to convey the incoming replacement or make up air through the plenum 13 to the lower outlet 12 and the rotatable controller 19 and then into the hood open area 30 and filter 27 and/or the open areas or occupied space 29 surrounding the ventilation system. The airflow patterns shown in FIG. 5 show how the make up air is brought into the plenum 13. Depending on specific conditions, the controller 19 or controllers would be set as desired. For example, during very cold weather, the controller 19 would be turned so that all the incoming airflow would be directed into the hood as shown in FIG. 2. The controller 19 would be closed when the cooking system is not in service, as shown in FIG. 1. If it were fairly warm the controller 19 could provide air solely into the open area 29 in front of the cooking equipment, as shown in FIG. 3, or in any combination thereof.

While I have described my invention in connection with specific embodiment thereof, it is clearly to be understood that this is done only by way of example and not as a limitation to the scope of my invention as set forth in the objects thereof and in the appended claims.

I claim:

1. A make-up air control system apparatus, for use in controlling replacement or make up air with cooking equipment ventilation hood systems, comprising:

a ventilation hood;

a plenum enclosure;

said plenum enclosure having an inlet;

said plenum enclosure further having an outlet;

said plenum enclosure comprising an integral part of the hood;

said plenum enclosure comprises a part of the building structure surrounding said hood;

said outlet having control means located therein;

said control means comprising a rotatable housing;

said rotatable housing having apertures located therein;

said control means further comprising attachment means;

said attachment means having apertures located therein; and pivot means for passing through said apertures in said rotatable housing and said attachment means to create a complete apparatus.

2. A make-up air control system apparatus, according to claim 1, wherein:

said plenum enclosure means comprises fire resistant material for assuring the fire resistant integrity of the system; and said fire resistant material comprises fire code sheet rock, metal, masonry, and any other non-combustible material.

3. A make-up control system apparatus, according to claim 1, wherein:

said control means comprises an arcuate air control section;

said control means has vertical end sections at each end of said arcuate air control section; and said end sections having said apertures located therein.

4. A make-up air control system apparatus, according to claim 1, wherein:

said attachment means comprises at least one bracket for receiving said pivot means and for precision positioning of said rotatable housing with the lower lateral edge of said ventilation hood.

* * * * *